US007752701B2

(12) United States Patent
Bohannon et al.

(10) Patent No.: US 7,752,701 B2
(45) **Date of Patent: *Jul. 13, 2010**

(54) CLEANING DEVICE FOR GOLF EQUIPMENT

(75) Inventors: Jeremiah Bohannon, Emerald Hills, CA (US); Darrell S. Staley, Santa Clara, CA (US)

(73) Assignee: Frogger, LLC, San Mateo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/473,467

(22) Filed: May 28, 2009

(65) Prior Publication Data

US 2009/0235475 A1 Sep. 24, 2009

Related U.S. Application Data

(63) Continuation of application No. 11/517,508, filed on Sep. 8, 2006, now Pat. No. 7,555,802.

(60) Provisional application No. 60/716,088, filed on Sep. 13, 2005.

(51) Int. Cl.

| | |
|---|---|
| ***A63B 57/00*** | (2006.01) |
| ***A46B 9/06*** | (2006.01) |
| ***A47L 13/12*** | (2006.01) |
| ***A47L 13/02*** | (2006.01) |
| ***A47L 13/022*** | (2006.01) |
| ***A47L 13/06*** | (2006.01) |
| ***A47L 13/08*** | (2006.01) |
| ***A47L 23/04*** | (2006.01) |

(52) U.S. Cl. ..... 15/113; 15/111; 15/160; 15/161; 15/176.1; 15/176.6; 15/236.01; 15/237; 15/DIG. 6; D4/118; D21/795; D32/42; D32/46; D32/47; D32/49

(58) Field of Classification Search ..... 15/105, 15/111, 113, 176.1, 176.6, 236.01, 237, 236.05–236.09, 15/DIG. 6, 159.1, 160, 161, 197, 200, 207.2; D4/116, 118; D21/793, 795; D32/42, 46, D32/47, 49

See application file for complete search history.

(56) References Cited

U.S. PATENT DOCUMENTS 108,108 A * 10/1870 Combs ..... 15/113

(Continued)

FOREIGN PATENT DOCUMENTS

EP 199835 * 11/1986

(Continued)

OTHER PUBLICATIONS

ProActive Sports Inc. Golf Accessories & Gifts; http://proactivesports.com/groove_brushes.html, Aug. 2006.

*Primary Examiner*—Mark Spisich
(74) *Attorney, Agent, or Firm*—Charter IP, LLC; Matthew J. Lattig

(57) ABSTRACT

A device for cleaning golf equipment such as golf clubs and golf shoe includes a handle, a brush head surface formed in an underside of the handle at a proximal end thereof, and a plurality of metal and plastic bristles extending downward from the brush head surface. The bristles are configured so that the plastic bristles are arranged around an outer circumference of the brush head surface to encircle the metal bristles extending from a central portion of the brush head surface.

12 Claims, 12 Drawing Sheets

U.S. PATENT DOCUMENTS

| | | | | | |
|---|---|---|---|---|---|
| 209,967 | A | * | 11/1878 | Gesswein | 15/160 |
| 296,674 | A | * | 4/1884 | Carlsen | 15/113 |
| 410,476 | A | * | 9/1889 | Woodard | 15/111 |
| 430,077 | A | * | 6/1890 | Jenness | 15/160 |
| 623,582 | A | * | 4/1899 | Vollmar | 15/113 |
| 1,377,215 | A | * | 5/1921 | Miller | 15/146 |
| 1,407,214 | A | | 2/1922 | Osborn | |
| 1,430,441 | A | * | 9/1922 | Forsberg et al. | 15/111 |
| 1,493,130 | A | * | 5/1924 | Stein | 15/111 |
| 1,564,526 | A | * | 12/1925 | Callais | 15/207.2 |
| 1,891,864 | A | * | 12/1932 | Barrett | 606/161 |
| 1,894,882 | A | * | 1/1933 | Mazzella | 15/176.6 |
| 1,958,658 | A | * | 5/1934 | Engberg et al. | 15/180 |
| 2,857,608 | A | | 10/1958 | Schwartz | |
| 3,094,728 | A | | 6/1963 | White | |
| D305,962 | S | * | 2/1990 | Ibanez | D4/116 |
| 5,230,117 | A | * | 7/1993 | Johnson et al. | 15/106 |
| 5,557,871 | A | | 9/1996 | Lalonde | |
| D395,551 | S | * | 6/1998 | McKittrick | D4/119 |
| 5,819,355 | A | | 10/1998 | Wu | |
| 5,857,234 | A | * | 1/1999 | Hernnandez | 15/111 |
| D418,892 | S | | 1/2000 | Corcoran | |
| 6,112,357 | A | | 9/2000 | Halloran | |
| 6,237,183 | B1 | * | 5/2001 | Fischer | 15/167.1 |

FOREIGN PATENT DOCUMENTS

| | | | |
|---|---|---|---|
| WO | 91/01777 | * | 2/1991 |

* cited by examiner

CLEANING DEVICE FOR GOLF EQUIPMENT

PRIORITY STATEMENT

This application is a continuation of and claims the benefit under 35 U.S.C. §120 to U.S. patent application Ser. No. 11/517,508, filed Sep. 8, 2006 to Bohannon, et al. and entitled "CLEANING DEVICE FOR GOLF EQUIPMENT", now U.S. Pat. No. 7,555,802, which claims the benefit of U.S. Provisional Application No. 60/716,088, filed Sep. 13, 2005. The entire contents of each application is hereby incorporated by reference herein.

BACKGROUND

1. Field

Example embodiments in general are directed to a device for cleaning golf equipment such as the heads and/or faces of golf clubs and/or soles of golf shoes.

2. Related Art

Golf club head cleaning devices typically characterized by a hand-held brush device having metal and/or plastic bristles at an end thereof for cleaning different types of clubs, e.g., faces of drivers/woods and/or faces of irons. Separate devices for cleaning debris or dirt from the grooves of club faces are also known, such as a metal spike device or nail with a point.

Certain combination golf club cleaning devices may include both a brush section and a groove cleaning fixture such as a spike or blade, each fixedly provided thereon. However, these conventional combination cleaning devices typically are cumbersome to the user, with the devices hooked on bags or carried in the pocket, where an exposed groove cleaner could injure the user or rip clothing. Further, the brush bristles and groove cleaner implements typically are not replaceable but are fixed as part of the contiguous cleaning device. As such, these devices must be thrown away once the groove cleaner dulls and/or once the bristles wear down to a point at which the brush becomes ineffective for cleaning a club head.

SUMMARY

An example embodiment of the present invention is directed to a device for cleaning golf equipment. The device includes a handle, a brush head surface formed in an underside of the handle at a proximal end thereof, and a plurality of metal and plastic bristles extending downward from the brush head surface. The bristles are configured so that the plastic bristles are arranged around an outer circumference of the brush head surface to encircle the metal bristles extending from a central portion of the brush head surface.

Another example embodiment is directed to a device for cleaning golf equipment that includes a handle having a proximal and distal end, a scraper pivotally attached to the handle proximate end on a top surface thereof by a pivot pin that is transverse thereto and connected to the handle, and a plurality of metal and plastic bristles extending downward from a bottom surface of the handle at the proximal end. The bristles are configured so that the plastic bristles are arranged around an outer circumference of the bottom surface to encircle the metal bristles extending from a central portion of the bottom surface of the handle.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figures 1A, 1F:
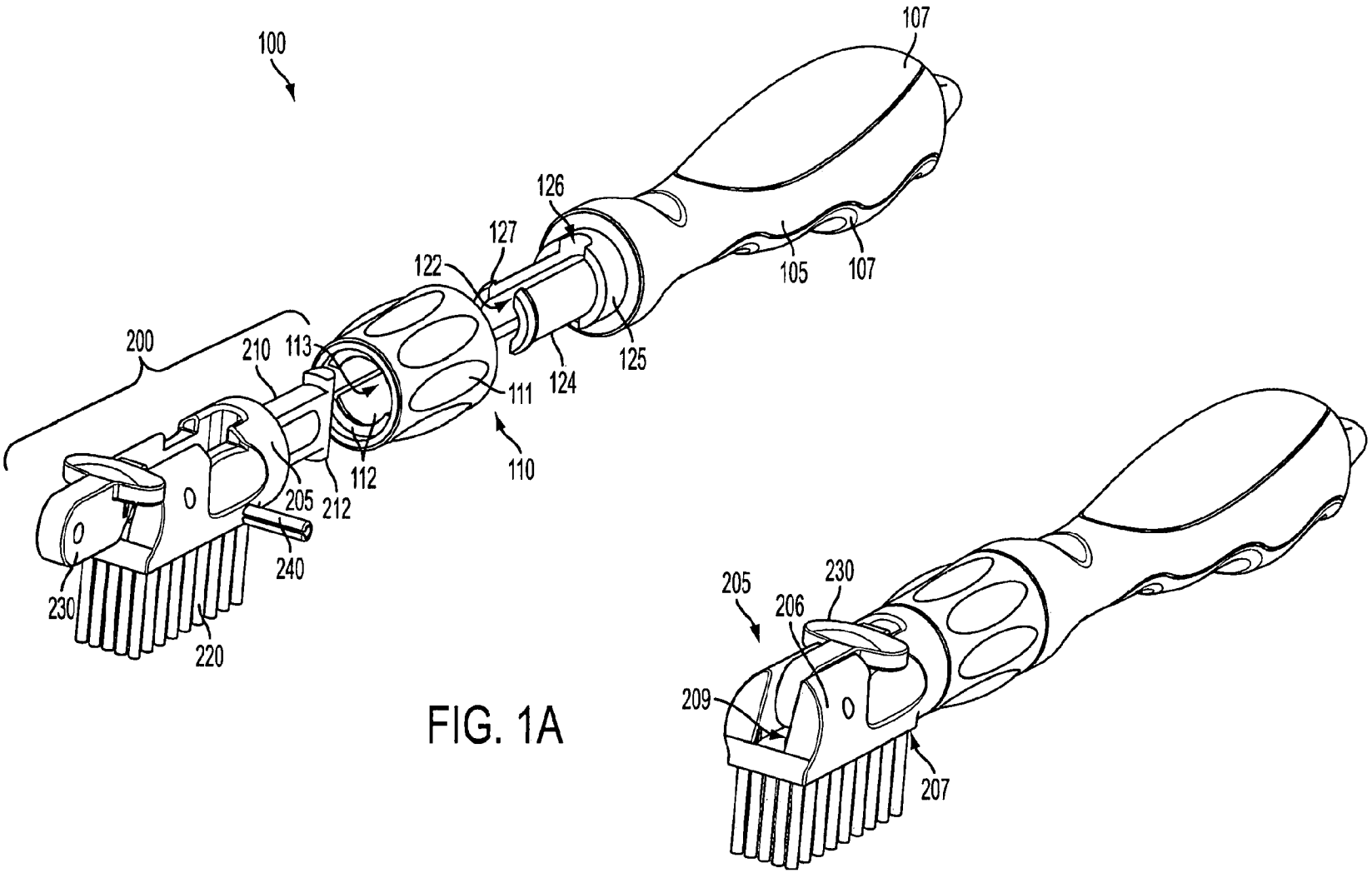
FIG. 1A is a partial exploded perspective view of a cleaning device in accordance with an example embodiment.
FIG. 1F is a perspective view of the cleaning device of FIG. 1A to illustrate the scraper block.

FIG. 1A is a partial exploded perspective view of a cleaning device in accordance with an example embodiment of the present invention, with FIGS. 1B-1F showing a partial exploded side view, top view, side view, bottom view and perspective view of the cleaning device of FIG. 1A. FIGS. 1A-1F should be referred to for the following discussion.

The cleaning device 100 provides a mechanism for cleaning the heads and/or faces of golf clubs and/or for cleaning other golf equipment such as golf shoes. The device 100 may hang from a golf bag via a standard retractor mechanism, in which a retractable cord or tether is attached to an eyelet 130 at a distal end of a handle 105. The retractor mechanism is described in more detail below.

As shown in FIGS. 1A-1E, the cleaning device 100 may include the handle 105, a nut 110, and a removable cleaning subassembly 200. The subassembly 200 may include a brush head 205, a brush 220 and a scraper block 230. The brush 220 may include a plurality of bristles extending downward from a first surface of the brush head 205, shown generally at 207. The scraper block 230 may also be pivotally connected to a second surface 209 of the brush head 205 so that the scraper block 230 is displaceable outward from the second surface 209 of the brush head 205 to expose a scraper or groove cleaner 235. As will be explained below, the groove cleaner 235 may be shaped so as to efficiently remove debris from club face grooves.

The retractor mechanism used to attach the device 100 to an external article such as a golf bag may be any off-the shelf product. As such, the example cleaning devices described herein or not limited to a particular type of retractor mechanism or retractable reel assembly as are known in the art. An example retractable reel assembly can include a carabineer connected to a top end of a retractable reel, with a cord, chain or tether pulled from the retractable reel being fixedly attached to the eyelet 130 of handle 105 directly (or to an eyelet 308 of a device 300 in a later-described embodiment). Alternatively, the free cord/chain/tether end which is pulled from the retractor mechanism may be connected directly to a ring that is connected to eyelet 130, or affixed to a lock element such as a ball or clasp which is connected to the ring, with the ring in turn connected to the eyelet 130. Example retractable reels of this type that could be used in conjunction with device 100 include several variations of retractable reels made by Key-Bak®, Inc., such as the Securit 488B, and/or several variations of retractable reels made by United Mercantile Exchange (UMX®, Inc.) which include a carabineer and ring for attaching the retractable reel assembly between two items.

In use, a user may grab the device 100, and pull it away from the external article (e.g., golf bag) to overcome the friction or retraction force applied by a helical spring or coil within the selected retractor mechanism, as is known in the art. The user cleans golf clubs and/or golf shoes, and then releases device 100. Device 100, under a retraction force applied on the cord, chain or tether by the helical spring or coil within the retractable reel assembly, snaps back to the bag due to the spring action imparted by the interior spring or coil.

Figure 8:
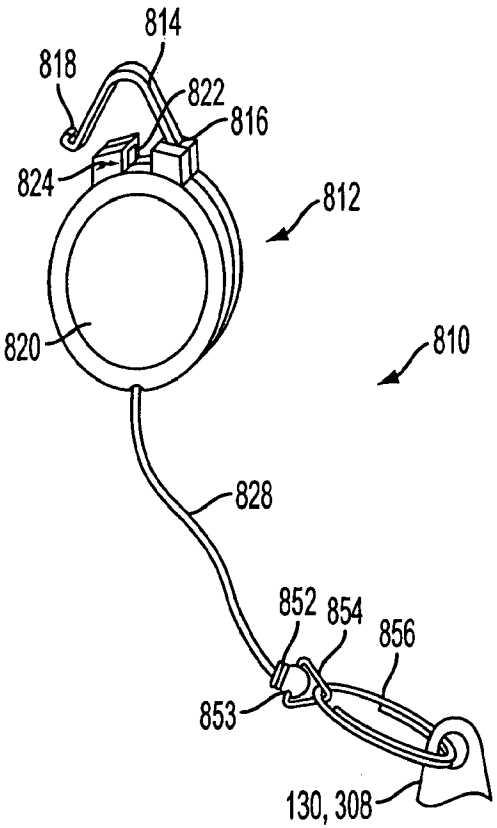
FIG. 8 illustrates an example retractor mechanism usable with the example devices for cleaning golf equipment.

FIG. 8 illustrates another example retractor mechanism usable with the example devices for cleaning golf equipment described herein, it being understood that FIG. 8 is provided only for illustrative purposes; the retractor mechanisms as described above may be used with device 100.

In FIG. 8, another example retractor mechanism 810 includes a tether housing 812 having a main body portion 820. Instead of using a carabineer, a fastening arm 814 is used to connect mechanism 810 to an external article. The fastening arm 814 has a first end 816 fixed to the main body portion 820 and a second hook end 818.

In use, the fastening arm 814 is able to capture an element (e.g., a ring) of an external article (e.g., a golf bag), neither of which are shown. To do so, as the arrows 824 indicate, a user presses the second end 818 of the fastening arm 814 away from a hook alcove 822 in which the second hook end 818 is normally retained and toward the first end 816 of the fastening arm 814. With this, the hook end 818 will be disengaged from a hook (not shown) within the hook alcove 822.

A user can then bend the fastening arm 814 to an open position as is shown in FIG. 8 to allow the second end 818 to pass through a ring of a golf bag, for example, to which the device 100 is to be attached. With a ring of a golf bag captured, the second end 818 of the flexible fastening arm 814 can be re-inserted into the hook alcove 822 and then released to allow the hook 818 to engage the hook (not shown) within alcove 822 to secure the retractor mechanism 810 to an external article.

A tether 828, which may be a nylon cord or chain, for example, extends from the tether housing 812 as shown. The tether 828 has a first end retained in a spool (not shown) within the housing 812. A second end of the tether 828 is fastened to a locking element 852. For example, the second end of tether 828 is inserted through a top end of the element 852 and knotted so that it is fixed to the locking element 852. The locking element 852 has a transverse hole 853 which receives a metal triangular clasp 854. The clasp 854 is shown attached to ring 856 which in turn is connected to eyelet 130. Thus, the second end of the tether 828 is fixedly fastened to a locking element 852, which in turn is attached to ring 856 via clasp 854. The ring 856 has an annular body portion which passes through eyelet 130 in the handle 105 of device 100, thereby fixedly attaching the retractor mechanism 810 to device 100 (or device 300 in later embodiments).

The spool within housing 812 may be biased to retract the tether 828 from an extended position by a helical metal spring or coil, as is-known in the art. As previously described above regarding the retractors with carabineer and reel assembly, the user pulls device 100 away from the bag to overcome the friction or retraction force applied by the retractor mechanism 810, cleans his golf equipment and then releases device 100, which snaps back to the bag due to spring action imparted by the spring or coil within the housing 812.

The handle 105, nut 110 and/or components of the subassembly 200 may be made primarily from lightweight materials such as moldable plastic. In an example, one or more of the handle 105, nut 110 and/or components of the subassembly 200 may be formed by an injection molding process from a high impact plastic, such as Acrylonitrile Butadiene Styrene (ABS), which is an easily machined, tough, low cost rigid thermoplastic material with high impact strength, and may be a desirable material for turning, drilling, milling, sawing, die-cutting, shearing, etc. Virgin ABS may be mixed with a plastic regrind of ABS or another lightweight, durable plastic material. ABS is merely an example material, equivalent materials may include various thermoplastic and thermoset materials, such as talc-filled polypropylene, high strength polycarbonates such as GE Lexan®, or blended plastics.

There are many known injection molding machines for forming plastic injection molds, other plastic molding processes such as vacuum forming may be used. Alternatively, handle 105, nut 110 and/or components of the subassembly 200 may be formed using a metal casting process such as sand casting, die casting, or investment casting, for example.

The handle 105 and nut 110 may include a rubber over mold, shown generally at 107 and 111. The rubber over molds 107, 111 provide an ergonomic design for the palm and fingers of a user's hand to enable the user to easily grip the handle 105 and/or manipulate nut 110 and provide better force for both genders to effectively clean golf clubs and/or golf shoes with bristles 222, 224 of the brush 220 of the groove cleaner 235 of the scraper block 230.

Unlike conventional golf club cleaning devices, the club cleaning subassembly 200 and constituent components of the subassembly are removable. As shown best in FIG. 1B, the subassembly 200 includes a male connector 210 that is designed for a 'snap-fit' within nut 110. As best shown in FIG. 1A, nut 110 has a central bore 113 there through that includes a pair of interior rib portions 112 on sides thereof which are adapted so that nut 110 can snap fit to handle 105. Handle 105 includes a female connector 120. Female connector 120 includes a channel 122 formed between projections 124. Each projection 124 includes a corresponding lip or bumper 127. The nut 110 is snap fit onto handle 105 so that the lips 127 extend into bore 113 and fit over its corresponding interior rib portion 112 within nut 110. Then, the subassembly 200 may be slid into nut 110, within channel 122 of female connector 120 adapted to receive a distal T-shaped end 212 of the male connector 210 therein. As will be explained below, nut 110 rotations in either desired direction tightens and secures subassembly 200 to nut 110 and handle 105. This provides a twist locking and/or twist tightening feature.

Referring to FIG. 1A, channel 122 is open at one end arid terminates at a keyway 126 within a cylinder portion 125 which abuts with and/or is connected to handle 105. With the handle 105 attached to nut 110, keyway 126 receives the T-shaped end 212 of the male connector 210 to allow nut 110 to rotate or twist. As shown in FIG. 1A, keyway 126 is shaped so as to facilitate engagement or alignment of the male connector 210 within female connector 120 as it passes through the central opening 115 of nut 110. Once the subassembly 200 is inserted through the nut 110 to engage the handle 105, the nut 110 may be rotated (in a desired direction) for tightening and locking of the subassembly 200 to the handle 105.

The bristles constituting brush 220 may include both plastic and metal bristles. As shown in FIG. 1E for example, and in an example arrangement, the brush 220 may comprise several interior rows of metal bristles 222 surrounded by an outer ring of plastic bristles 224. In an example, metal bristles 222 may be made a phosphorous bronze metal material, although other metal materials could be used such as various metal alloys of brass, stainless steel, nickel, copper, etc.

The example arrangement of metal bristles being surrounded by plastic bristles may facilitate cleaning of clubs and the bottom of golf shoes. Including interior metal bristles 222 with plastic bristles 224 serving as an exterior ring of the brush 220 may reduce the likelihood of bending of the metal bristles 222, and/or serves as a buffer row of bristles to prevent bent metal bristles 222 from extending beyond the exterior of the device 100. This may reduce the likelihood of metal bristles 222 catching on clothing items, hanging golf towel bags, and/or accidentally poking the user while in use. However, the example embodiments are not limited to the combination of plastic bristles surrounding metal bristles. In alternative example, the bristles 222, 224 may be all plastic or all metal. In a further alternative, the diameter of the bristles may be the same or different diameters, for example.

Figure 1B:
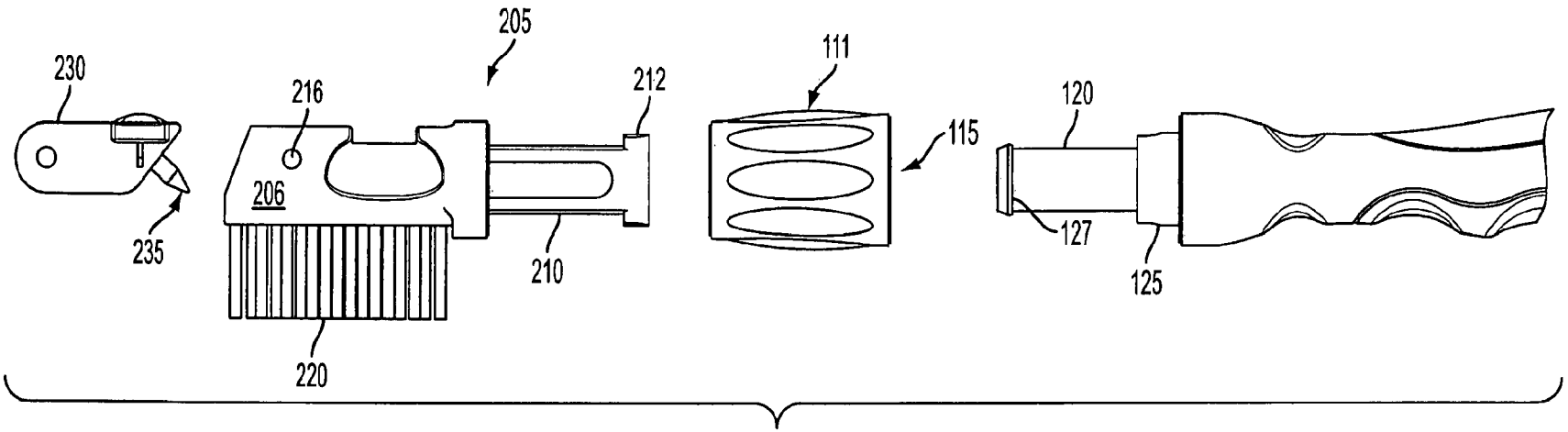
FIG. 1B is a partial exploded perspective view of the cleaning device of FIG. 1A.
Figure 1C:
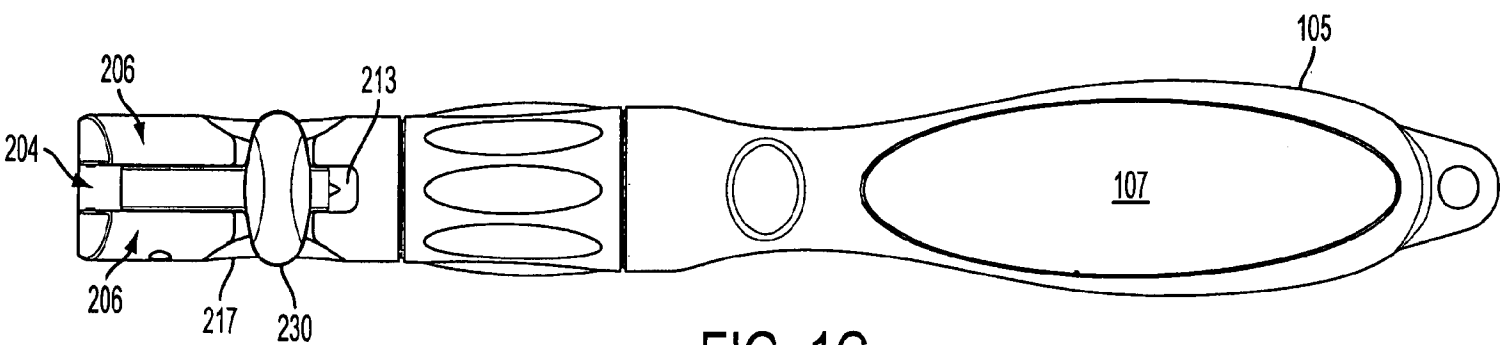
FIG. 1C is a top view of the cleaning device of FIG. 1A.
Figure 1D:
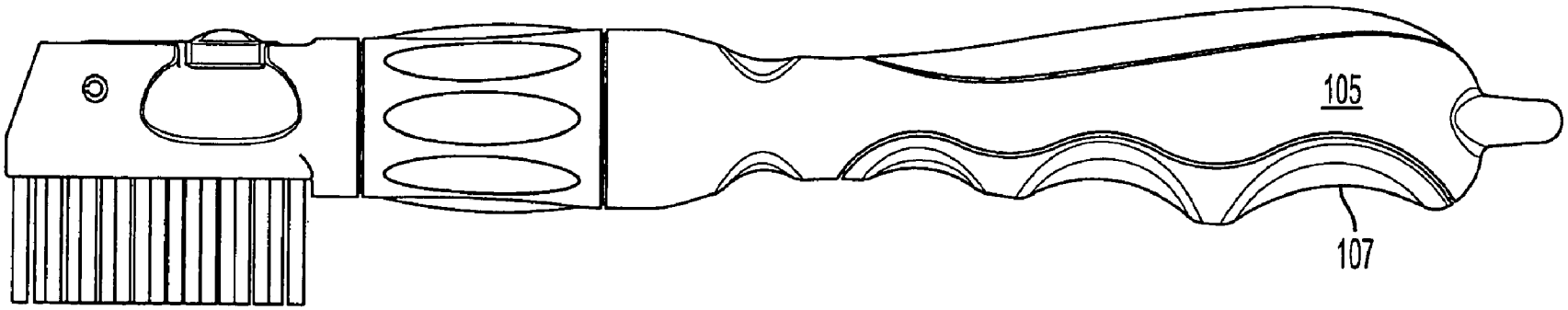
FIG. 1D is a side view of the cleaning device of FIG. 1A.
Figure 2A:
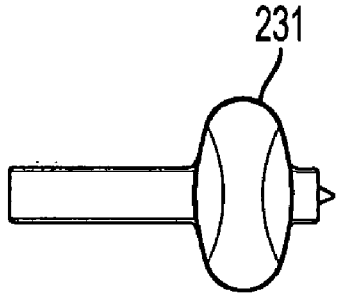
FIG. 2A is a top view of the scraper block in FIG. 1A.
Figure 2B:
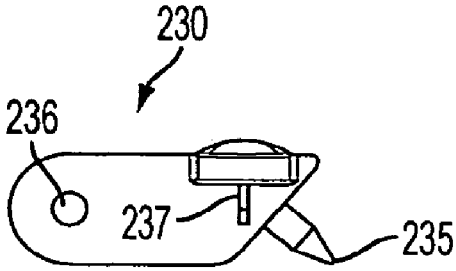
FIG. 2B is a side view of the scraper block in FIG. 1A.
Figure 2C:
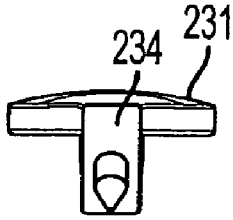
FIG. 2C is a front view of the scraper block in FIG. 1A.

FIG. 2A-2C illustrate top, side and front views of the scraper block 220 in FIG. 1A. Occasional reference should be made to FIGS. 1A and 1B. The scraper block 230 may be arranged on a top surface of the brush head 205 of subassembly 200. As shown, scraper block 230 may fit within a channel 204 (see FIG. 1C) formed between sidewalls 206 of the brush head 205. As shown in FIGS. 2A-2C, scraper block 230 may include a handle 231 and a front face 234 from which protrudes a groove cleaner or scraper 235. The groove cleaner 235 may have a generally pointed or tapered end shape such as a nail to engage clubface grooves, but could also be configured in a generally flat planar dimension which fits into a groove of a clubface.

Each sidewall 206 of the brush head 205 may be provided with a bore of tapped hole, shown at 216 in the sidewall 206 of FIG. 1B. A bore is also provided through the scraper block 230, shown at 236 in FIG. 2B. These tapped holes 216, 236 align to receive a pivot spring pin 240 which secures the scraper block 230 to the brush head 205 of subassembly 200. The pivot spring pin 240 may be embodied as a spring-loaded pin which enables the scraper block 230 to rotate from a friction-locked position in which the groove cleaner 235 is secured between the sidewalls 206 and hence not open to expose the groove cleaner 235.

Figure 1E:
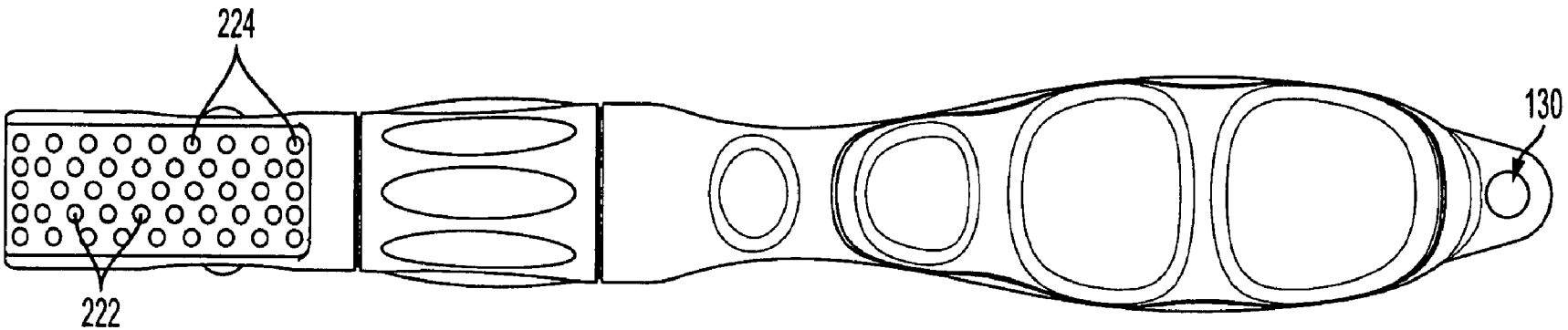
FIG. 1E is a bottom view of the cleaning device of FIG. 1A.

As shown in FIG. 1C and with reference to FIG. 2B, the scraper block 230 can be locked so that the groove cleaner 235 resides in a recess portion 213. The scraper block 230 includes wedge portions 237 which frictionally engage protrusions 217 within channel 204, upon user hand-closing pressure, so as to effectively place scraper block 230 in the closed or locked position.

The user pulls open scraper block 230 to overcome the friction hold at interface 237/217 to rotate the scraper block 230 toward the open position. Once in the open position, another pair of wedge portions (not shown) on facing interior surfaces 209 (FIG. 1F) of sidewalls 206 frictionally engage scraper block 230 so that groove cleaner 235 can be secured in a locked-open position. Groove cleaner 235 may then be used to effectively clean out the grooves of golf clubs and/or the bottom of shoes. Once securely retracted/rotated back into the brush head 205 as shown in FIG. 1C, the groove cleaner 235 is safely out of harm's way.

Since the subassembly 200 is replaceable, the device 100 is configurable with other component variations (e.g. all plastic bristles, all metal bristles, different groove cleaner 235 and/or scraper block 230 configuration, etc.). In addition, it would be evident to the ordinary skilled artisan to attach other types of cleaning subassemblies or components to the handle 105, such that device 100 could be used in other areas beyond the cleaning of golf clubs and shoes.

Accordingly, the aforementioned figures illustrate a subassembly 200 of a golf equipment cleaning device 100 in which either or both of the brush head 205 or groove cleaner 235 may be replaced therein.

Figure 3A:
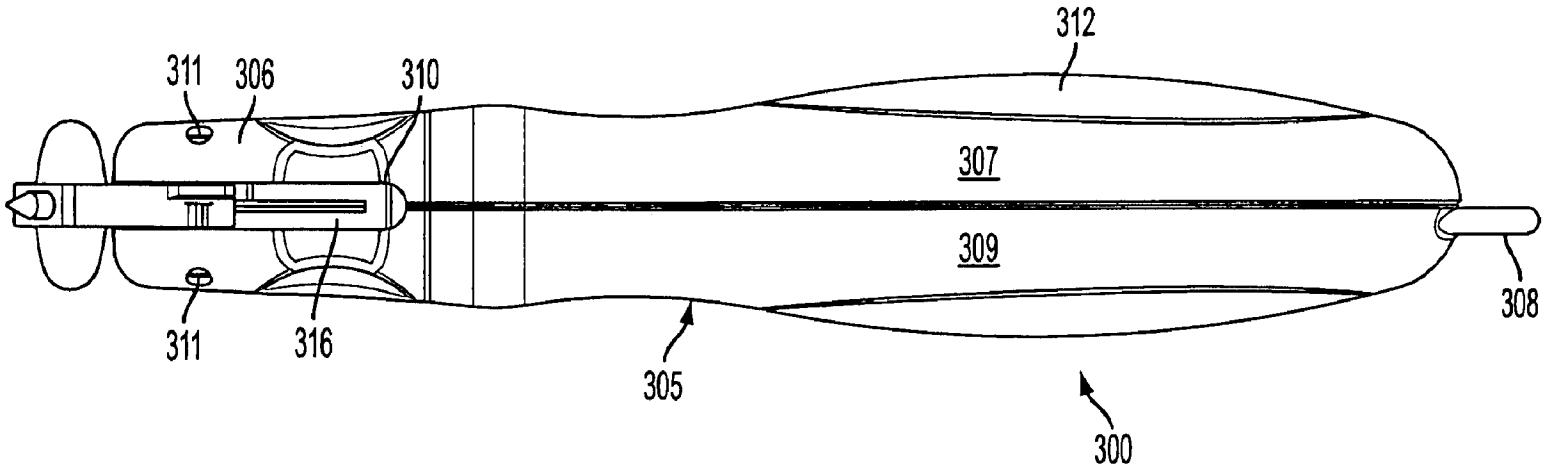
FIG. 3A is a top view of a cleaning device iii accordance with another example embodiment.
Figure 3B:
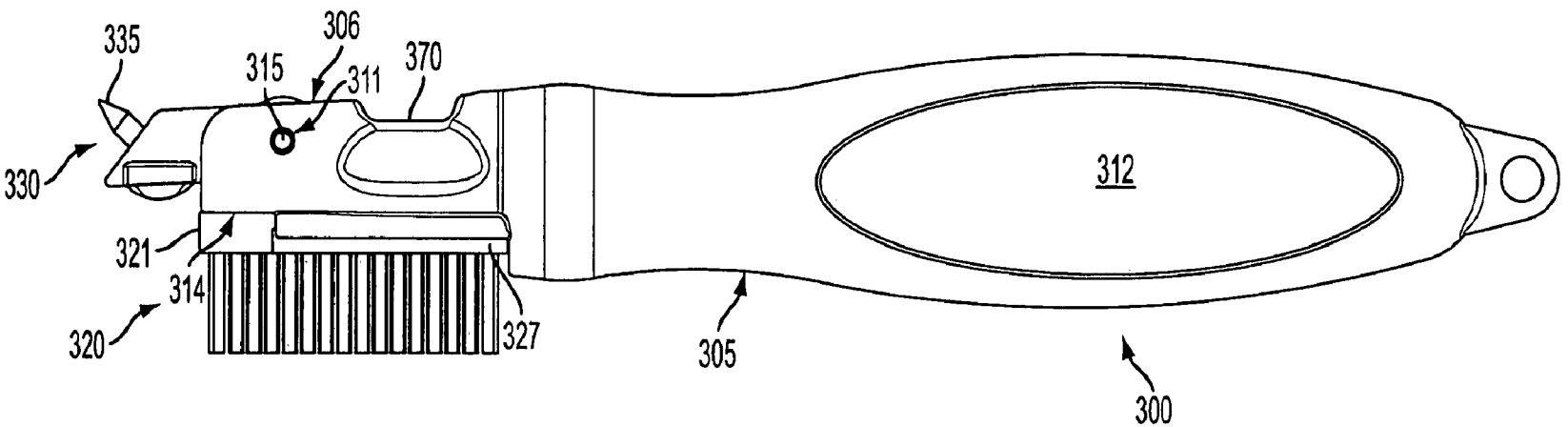
FIG. 3B is a side view of the cleaning device of FIG. 3A.
Figure 3C:
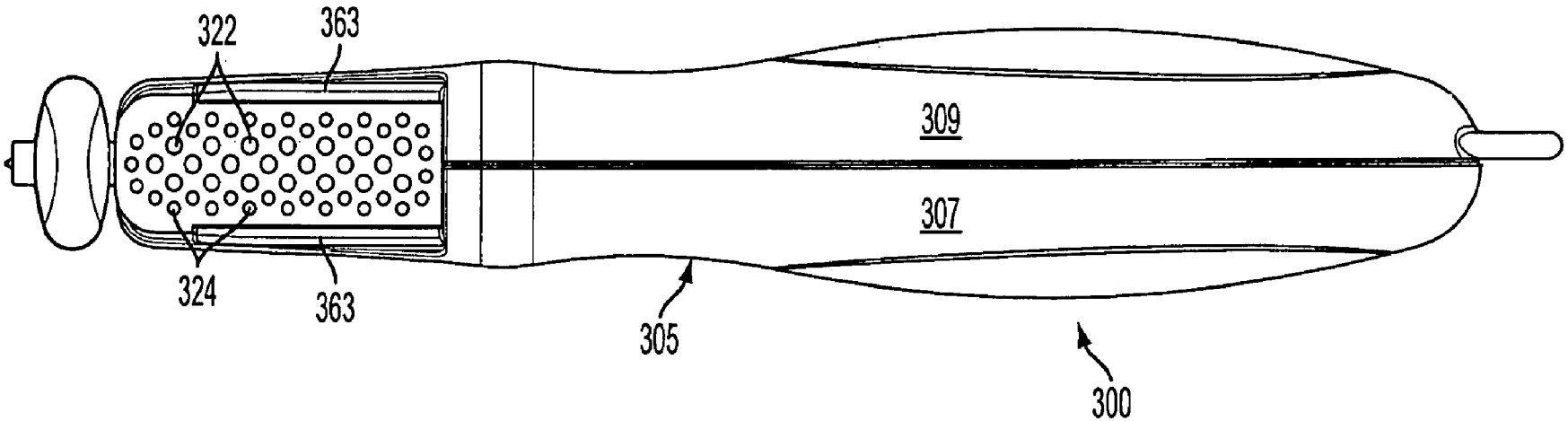
FIG. 3C is a bottom view of the cleaning device of FIG. 3A.

FIGS. 3A-3C illustrated a device for cleaning golf equipment in accordance with another example embodiment. FIG. 3A illustrates a top view, FIG. 3B a side view and FIG. 3C a bottom view of a device 300.

Referring to FIGS. 3A to 3C, device 300 may be comprised of an elongated handle 305 which includes a generally rectangular shaped brush assembly 320 removably attached at a proximal end of the device 300 so as to contact or abut a first surface 314 at the proximal end of the device 300. The device 300 may include a scraper block 330 that is pivotally connected at the proximal end of the handle 305 (and hence a proximal end of device 300) above the brush assembly 320 on a second surface 316. As shown in FIG. 3A, the scraper block 330 is pivotable within a longitudinal channel 310. This channel 310 is formed in an upper portion 306 of the handle 305 at the proximal end of handle 305/device 300, as shown in FIGS. 3A and 3B, and secured to the upper portion 306 by a pivot spring pin 315. The pivot spring pin 315 is oriented transverse to the rotation of the scraper block 330 within the channel 310 to connect the scraper block 330 to the handle 305. As shown in FIG. 3A, the pivot spring pin 315 fits through bores 311 in the sides of the device 300 that are aligned with an opening or bore through the scraper block 330 (not shown). Although scraper block 330 rotation within the longitudinal channel 310 between closed and open positions is described in further detail hereafter, each of FIGS. 3A-3C illustrate the scraper block 330 in a fully-extended outward position exposing a scraper or groove cleaner 335.

The handle 305 is comprised of two halves 307 and 309 and may include an eyelet 308 in one of the halves, here shown as half 309 in FIG. 3A. The eyelet 308, as described in the previous example embodiment of FIGS. 1A-2C, may be connected to any of the aforementioned retractor mechanisms, such as those having a carabineer, retractable reel and ring arrangement or the example mechanism 810 as described in FIG. 8 to allow usage of the device 300 by pulling the device away from the retractor mechanism on an external article such as a golf bag, for example.

The handle halves 307,309 and constituent interior elements thereof may be formed by an injection molding process from a high impact plastic, such as ABS, or another lightweight, durable plastic material. ASS is merely an example material, equivalent materials may include various thermoplastic and thermoset materials, such as talc-filled polypropylene, high strength polycarbonates such as GE Lexan®, or blended plastics.

The handle 305 may include a rubber over mold insert on each handle half 307, 309, shown generally at 312. The rubber over mold inserts 312 provide an ergonomic design for the palm and fingers of a user's hand to enable the user to more easily grip the handle 305 to effectively clean golf equipment with bristles 322, 324 (FIG. 3C) of the brush assembly 320 and/or with the groove cleaner 335 of the scraper block 330. In an example, product identification such as the product name and/or manufacturer information may be stamped or formed on the inserts 312.

As shown in FIG. 3C, there are different bristles 322 and 324 of the brush assembly 320. FIG. 3C also illustrates guide channel slots 363 in an underside of the device 300. The guide channel slots 363 are configured to engage corresponding recessed channel slots 327 on the sides of the brush head 321 of brush assembly 320, as shown generally in FIG. 3B.

Figure 4:
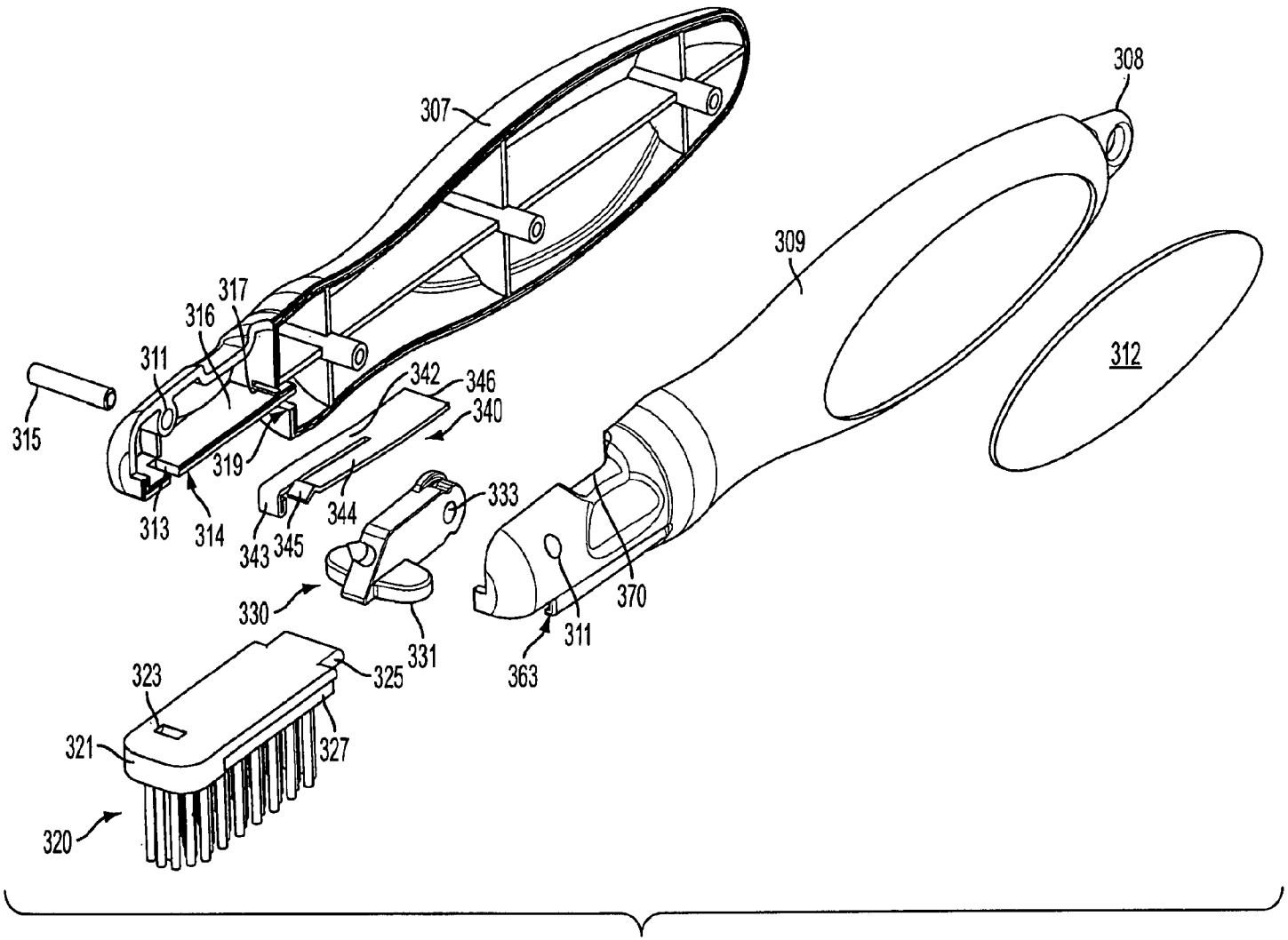
FIG. 4 is a partial exploded perspective view of a cleaning device shown in FIGS. 3A-3C.

FIG. 4 is a partial exploded perspective view of a cleaning device shown in FIGS. 3A-3C. Referring to FIG. 4, the brush head 321 of the brush assembly 320 contacts a first underside surface 314 of the handle 305 as the recessed channels 327 of the brush head 321 are slidably received within corresponding guide channel slots 363 at and underside of device on handle 305.

The brush head 321 additionally includes a tab portion 325 receivable within a slot 319 formed between the two halves 307, 309 of handle 305. A part of the slot 319 is shown in handle half 307 of FIG. 4. The first surface 314 terminates at the slot 319. The slot 319 receives the tab portion 325 as the recessed channels 327 of the brush assembly 320 slide into the guide channel slots 363. The slot 319 therefore provides a stop for brush assembly 320 sliding movement along the first surface 314 into the proximal end of handle 305. Further, the brush assembly 320 is therefore slidably inserted into a proximal end of the handle 305 so that the tab portion 325 is received into the slot 319.

The brush head 321 further includes a recessed notch 323 on a top surface thereof. As will be seen in further detail hereafter, a first finger 342 of a tension element 340 is designed to protrude through an opening 313 in the first and second surfaces 314, 316 of handle 305 so as to engage the recessed notch 323. The tension element 340 may be made of a metal such as aluminum for example. The engagement of a downward bent tip 343 of the first finger 342 within the recessed notch 323 on the brush head 321 provides a way to secure the brush assembly 320 to the handle 305 at the proximal end of device 300. The tension element 340 rests on the second surface 316 and engages the scraper block 330. The first finger 342 protrudes through an opening 313 end the first and second surfaces 314 and 316 as shown in FIG. 4 to engage the recessed notch 323 on the brush head 321 of the brush assembly 320.

FIG. 4 more clearly illustrates the pivot spring pin 315, which is insertable (or removable) through bores 311 which are aligned with opening 333 in the scraper block 330 to secure and/or to replace the scraper block 330 in device 300. Accordingly, the scraper block 330 is replaceable by removing the pivot spring pin 315 from the device 300, removing the scraper block 330 from the longitudinal channel 310 and then replacing it with a new scraper block. Thereafter, the opening 333 is aligned to the bores 311 and the pivot spring pin 315 be reinserted to secure the new scraper block 330 therein.

The tension element 340 has an end part 346 which is received in the corresponding slot 317 to secure the tension element therein. A portion of slot 317 is shown in handle half 307 of FIG. 4. The tension element 340 also includes a second finger 344. The second finger 344 has a ramp 345 thereon which provides frictional resistance to the movement of the scraper block 330 as described in more detail below.

Figure 5:
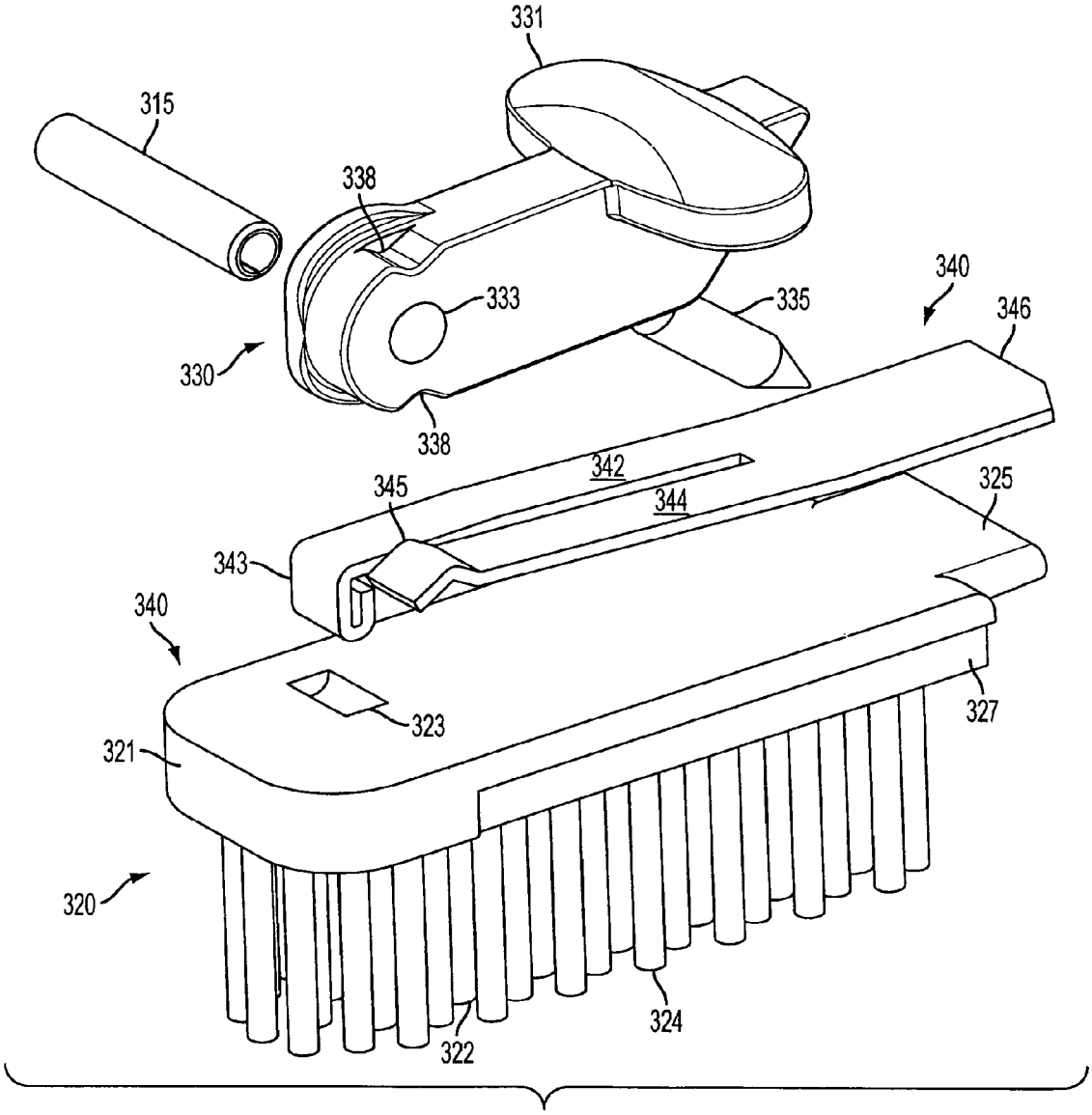
FIG. 5 is an enlarged perspective view of a brush assembly, a tension element and a scraper block in the cleaning device of FIGS. 3A-3C.

FIG. 5 is a partial exploded view to illustrate further detail of the scraper block 330, tension element 340 and brush assembly 320 of device 300. Occasional reference should be made to FIG. 4. The handle 305 is omitted in FIG. 5. FIG. 5 is provided to more clearly illustrate the relationship between the first finger 342 of the tension element 340 and the surface of brush head 321. The tip 343 of the first finger 342 is adapted to extend through opening 313 (see FIG. 4) to be received in the recessed notch 323 on the top surface of the brush head 321 of the brush assembly 320. The ramp 345 at the end of second finger 344 acts as a counter-force element against scraper block 330 travel, during rotation of block 330 from an inwardly secured position through a 180 degree travel to a fully extended position.

In FIG. 5, the scraper block 330 includes a handle portion 331 formed as a top surface thereof, and a scraper or groove cleaner 335 extending outward from an angled surface of block 330. Additionally, FIG. 5 illustrates the recessed channels 327 on the sides of the brush head 321 which are received in the corresponding guide channel slots 363 at an underside of the device 300, so that the top surface of the brush head 321 abuts the underside first surface 314 of the handle 305 as shown in FIG. 4, for example. As best shown in FIG. 5, the scraper block 330 has indentations 338 which mate with the ramp 345 on the second finger 344 of the tension element 340 when the scraper block 330 is in a secured inward position, or once it has been rotated 180 degrees to a full-extended outward position. This mating arrangement in which the ramp 345 is received within a given indentation 338 helps to fixedly maintain the scraper block 330 in either of the secured inward or fully-extended outward positions.

Accordingly, the tip 343 of the first finger 342 extends through the opening 313 in the first and second surfaces 314, 316 to act as a stop for the brush assembly 320. The engagement of tip 343 within recessed notch 323 locks the brush assembly 320 to the handle 305's proximal end when the scraper block 330 is in any position other than 90 degrees from the secured inward position or fully-extended outward position. The ramp 345 acts as a counter tension to scraper block 330 pivoting movement back and forth between the secured inward and fully-extended outward positions, and rests within indentations 338 (as best shown in FIG. 5) when the scraper block 330 is in either the secured inward position or fully-extended outward position.

Figure 6A:
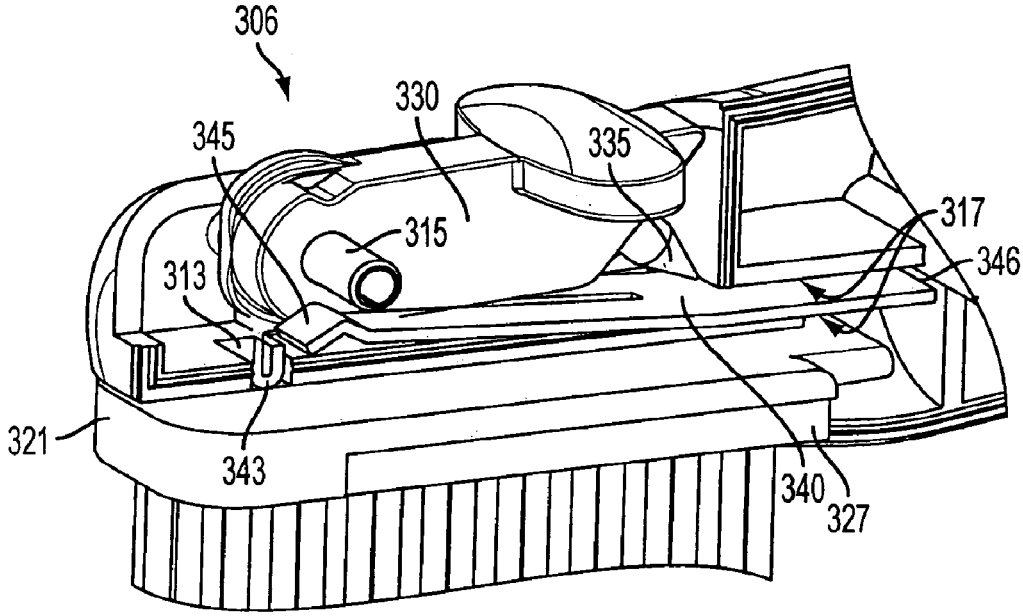
FIG. 6A is a perspective, enlarged cut-away view of a portion of the brush assembly and scraper block at the proximal end of the handle to illustrate the scraper block in a secured inward position.
Figure 6B:
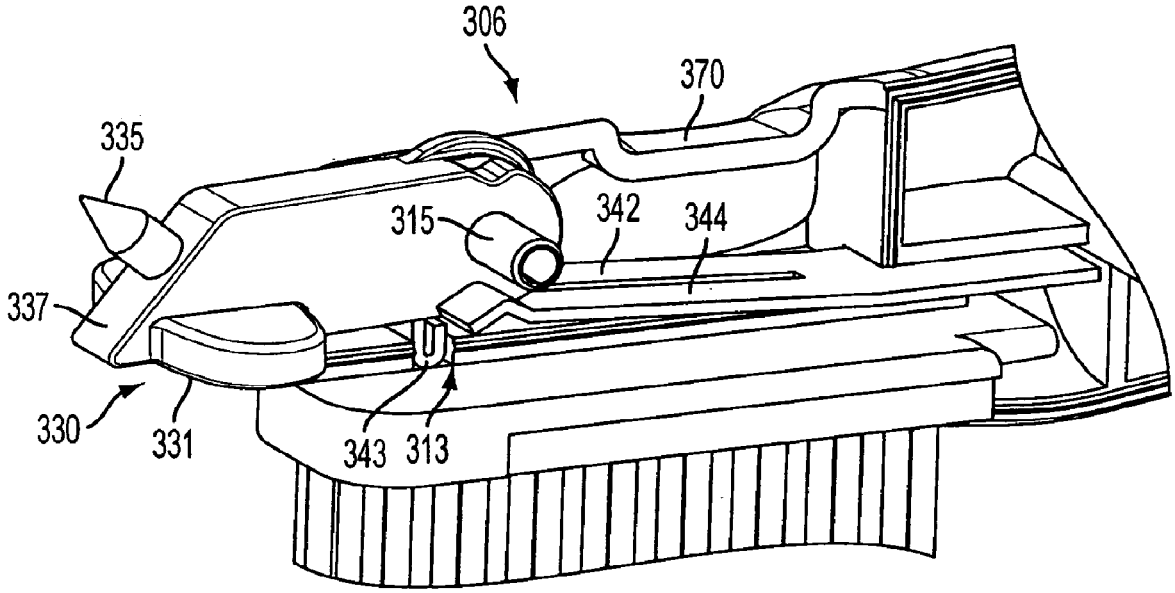
FIG. 6B is a perspective, enlarged cut-away view of a portion of the brush assembly and scraper block at the proximal end of the handle to illustrate the scraper block in a fully-extended outward position.

FIGS. 6A and 6B illustrate enlarged cut-away views of a portion of the scraper block 330 and brush assembly 320 so as to illustrate the relationships between the tension element 340 and scraper block 330 for a Closed position (FIG. 6A) and a fully open position (FIG. 6B) of the scraper block 330. Referring to FIG. 6A, in the fully closed or secured inward position, the scraper block 330 is oriented such that the scraper 335 and handle portion 331 are pointed toward the rear of device 300. The tip 343 of first finger 342 is shown extending through the opening 313 and into the recessed notch 323 of the brush head 321. This exploded cutaway view further illustrates the end part 346 of the tension element 340 secured within slot 317 and more clearly illustrates that the scraper block 330 resides on a different surface 316 (which forms the top surface of tension element 340) than the underside surface 314 which abuts the removably slidable brush assembly 320.

FIG. 6B illustrates the scraper block 330 in a fully extended (open) position. Similar to the fully closed position, the brush assembly 320 may not be removed from device 300 due to the locking feature provided by the tip 343 of first finger 342 engaging the notched recess 323 of the brush head 321, although the recess 323 is not clearly shown in FIG. 6B. Therefore, the tip 343 of the first finger 342 in its bent downward position acts as a locking mechanism for the brush assembly 320. As described above, the second finger 344 with its ramp 345 acts as a counter tensioning element to the pivot spring pin 315 as the scraper block 330 pivots or rotates back and forth in a 180 degree travel between open (fully-extended outward position) and shut (secured inward position).

FIG. 6B also illustrates a depression 370 that is provided in the upper portion 306 of handle 305 (see also FIG. 38) so as to receive the handle portion 331 of the scraper block 330. Additionally, FIG. 6B best illustrates that the scraper 335 protrudes from an angled surface 337 of the scraper block 330 which is adjacent to the top surface formed as the handle portion 331.

Figure 7:
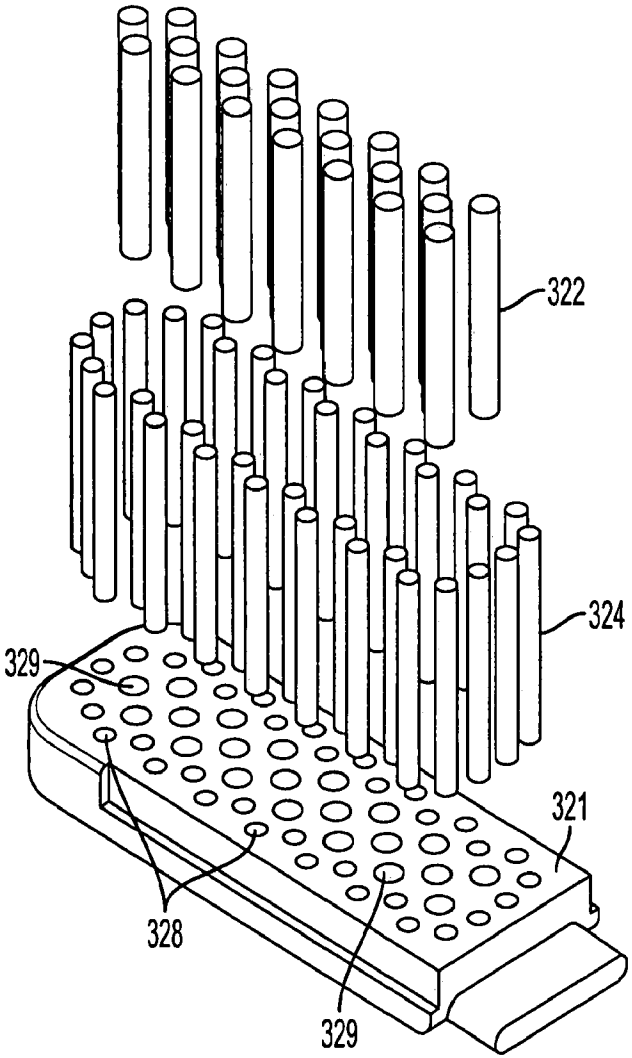
FIG. 7 is an exploded view of a portion of the brush assembly to illustrate the brush head, metal bristles and plastic bristles.

FIG. 7 is an exploded view of a portion of the brush assembly to illustrate the brush head, metal bristles and plastic bristles. The brush head 321 includes bristle holes 328 and 329. In an example, these holes may have different diameters to accommodate different diameter bristles. In FIG. 7, exterior holes 328 around the outer circumference of the brush head 321 receive corresponding plastic bristles 324, which in an example may be nylon, although other plastic based materials may be used for bristles 324. Metal bristles 322 are received in the larger diameter holes 329 within brush head 321. These metal bristles 322 may be made of a phosphorous bronze metal material, although other metal materials could be used such as brass and/or various other metal alloys of stainless steel, nickel, copper, etc.

Accordingly, the scraper block 330 is pivotally rotatable between a closed position, in which in one example a conically-shaped, tapered metal groove cleaner 335 is secured within the handle 305, and an open position in which the groove cleaner 335 rotates 180 degrees to a fully-extended position so as to be exposed for cleaning golf equipment such as clubface grooves or golf shoes, for example. Additionally, the embodiment as described in FIGS. 3A-7 provides a device 300 in which either the brush assembly 320 or the scraper block 330 is easily replaceable.

Figure 9:
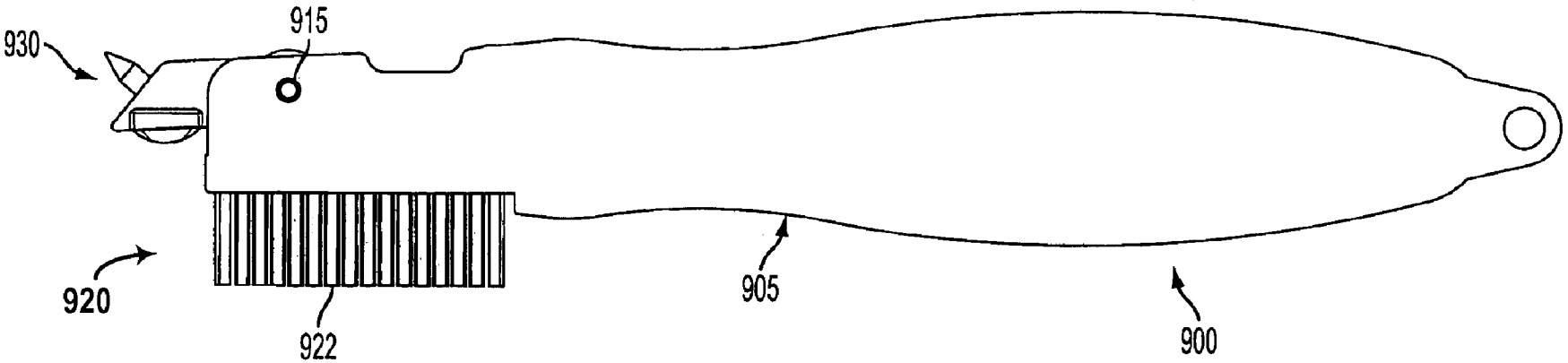
FIG. 9 is a side view of a cleaning device in accordance with another example embodiment.

FIG. 9 is a side view of a device for cleaning golf equipment in accordance with another example embodiment. FIG. 9 should be read with occasional reference to FIGS. 3B through 7. FIG. 9 is similar to FIG. 3C in most respects; however, in FIG. 9 there is no replaceable brush assembly 320, the brush 920 is a fixed part of the device 900. In an example, the brush 920 may be integrally formed with the handle 905.

However, the device 900 does include a replaceable, pivotable scraper block 930, which functions as substantially shown and described in FIGS. 5A and 5B, for example. A difference is that the first and second fingers 342 and 344 of a tension element (not shown here, see FIG. 5) may each have ramps 345 (and no tip 343) to provide a tensioned counterforce or friction against the pivot spring pin 915 during pivoting or rotational movement of the scraper block 330. There is thus no need for a tip 343 on the first finger 342 as the brush 920 is a fixed part of the handle of device 900. Bristles 922 may be a mixture of plastic and metal bristles of differing diameters as shown in FIG. 7. In alternative examples, bristles 922 may be all plastic or all metal bristles, for example, of the same or different diameters.

Figure 10:
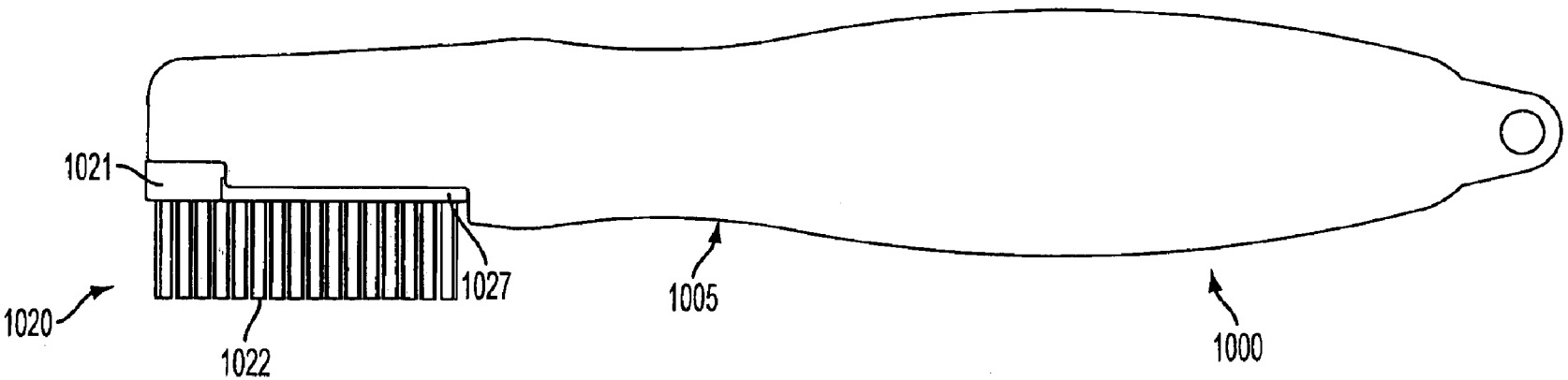
FIG. 10 is a side view of a cleaning device in accordance with another example embodiment.

FIG. 10 is a side view of a device for cleaning golf accessories in accordance with another example embodiment. FIG. 10 should be read with occasional reference to FIGS. 3B through 7. FIG. 10 is also similar to FIG. 3B, but device 1000 does not include a replaceable scraper block, only a removable or replaceable brush assembly 1020, the configuration of which is similar as shown and described in FIGS. 3B, 4 and 5. Accordingly, the replaceable brush assembly 1020 includes a generally rectangular brush head 1021 with a pair recessed channels 1027 formed along sides thereof. The channels 1027 may be slidably inserted into corresponding channel guide slots (not shown) such as the guide channel slots 363 shown in FIG. 4 at the proximal end of the device 1000.

The brush assembly 1020 in FIG. 10 may be held in place within the handle 1005 of device 1000 due to friction between surfaces of the recessed channels which contact the guide channel slots on the underside of the device 1000, such as is shown in FIG. 4, for example. In this embodiment, the friction engagement between surfaces of the recessed channels 1027 and guide channel slots (such as slots 363) serve as a means of securing the brush head assembly 1020 to the handle 1005 of device 1000; therefore no tension element 340 is used in this embodiment. In other words, there is frictional resistance between the surfaces as the recessed channels 1027 engage the channel guide slots as the brush head assembly 1020 is inserted into the handle 1005 (or removed there from) so as to fixedly secure the brush head assembly 1020 to the handle 1005.

Bristles 1022 may be a mixture of plastic and metal bristles of differing diameters as shown in FIG. 7. In alternative examples, bristles 1022 may be all plastic or all metal bristles, for example, of the same or different diameters.

Figure 11A:
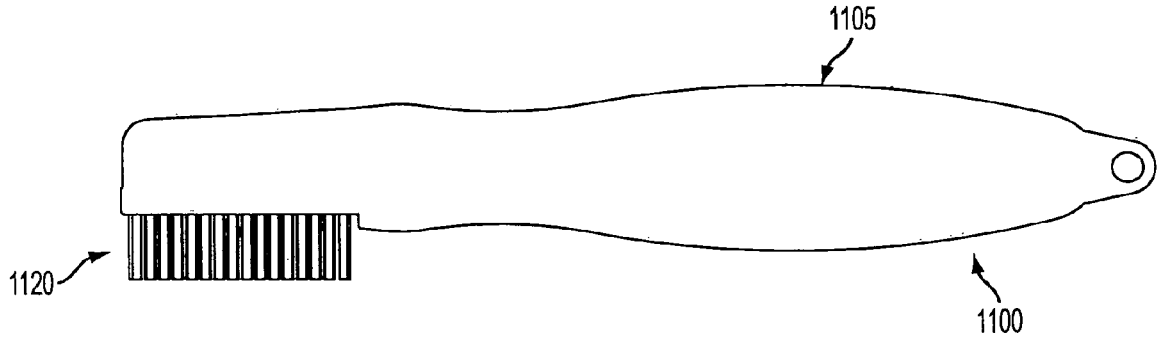
FIG. 11A is a side view of a cleaning device in accordance with another example embodiment.
Figure 11B:
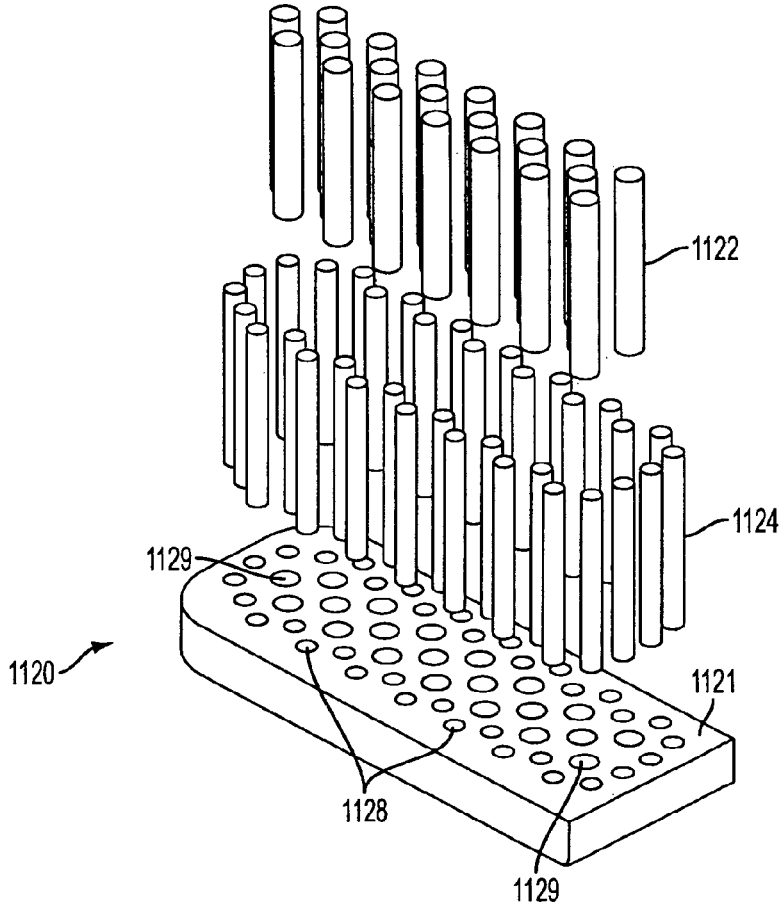
FIG. 11B is an exploded view of a portion of the device in FIG. 11A to illustrate the brush head, metal bristles and plastic bristles.

FIG. 11A is a side view of a cleaning device in accordance with another example embodiment, and FIG. 11B is an exploded view of a portion of the device in FIG. 11A to illustrate the brush head, metal bristles and plastic bristles.

In FIGS. 11A and 11B, the device 1100 includes no removable brush assembly but rather a fixed brush 1120 attached to handle 1105. FIGS. 11A and 11B should be read with occasional reference to FIG. 7. The device 1100 includes no scraper block pivotally connected at an end thereof for rotational movement. The device 1100 of FIGS. 11A and 11B include a handle 1105 to which a bristle arrangement similar to as shown in FIG. 7 is affixed thereto or integrally molded therein, with a particular orientation of bristles extending from a brush head surface 1121 of the device 1100. In this example, a plurality of bronze phosphorus bristles 1122 may be arranged in an interior portion on the brush head surface 1121 and are received in holes 1129. These are surrounded in an outer circumference of the brush head surface 1121 by a plurality of nylon bristles 1124 receivable in holes 1128. As can be seen, the diameters of the bristles 1122, 1124 and holes 1128, 1129 are different, with the bronze phosphorus bristles 1122 and corresponding holes 1129 having a wider diameter than the nylon bristles 1124 and corresponding holes 1128. Accordingly, the bristle configuration in 118 is similar to FIG. 7 with the exception that the bristles 1122, 1124 are attached to a brush head surface 1121 of a brush 1120 that is fixed to and/or integrally formed as part of device 1100, and hence not replaceable.

The example embodiments being thus described, it will be obvious that the same may be varied in many ways. Such variations are not to be regarded as departure from the example embodiments, and all such modifications as would be obvious to one skilled in the art are intended to be included herein.

What is claimed is:

1. A device for cleaning golf equipment, comprising:

a handle, a brush head surface formed in an underside of the handle at a proximal end thereof, a removable groove cleaner assembly pivotally connected to the proximal end within a channel formed in a top surface of the handle at the proximal end, the groove cleaner assembly including a scraper pivotally connected to the handle and extendible outward from the handle top surface via a transverse pivot pin attached to the handle, and a plurality of metal and plastic bristles extending downward from the brush head surface and configured so that the plastic bristles are arranged around an outer circumference of the brush head surface to encircle the metal bristles extending from a central portion of the brush head surface.

2. The device of claim 1, wherein the diameter of the metal bristles is different from the diameter of the plastic bristles.

3. The device of claim 1, wherein the diameter of the metal bristles is wider than the diameter of the plastic bristles.

4. The device of claim 1, wherein the metal bristles are bronze and the plastic bristles are nylon.

5. The device of claim 1, wherein the plurality of metal and plastic bristles are part of a brush assembly that is removable from the handle end, the brush assembly being generally rectangular and having a recessed channel along each long side thereof that is shaped to engage a corresponding guide channel slot formed along each edge of a bottom surface at the handle proximal end to slidingly engage the brush assembly to the handle.

6. The device of claim 5, wherein the brush assembly has a tab portion at an end thereof, and the bottom surface at the handle proximal end terminates at a slot that is to receive the tab portion as the brush assembly slides into the guide channel slots, the slot providing a stop for brush assembly sliding movement onto the bottom surface.

7. The device of claim 1, wherein the scraper is pivotally rotatable via the pivot pin between a closed position, in which the scraper is secured within the channel, and an open position in which the scraper rotates up to 180 degrees to a fully-extended position.

8. The device of claim 1, wherein the groove cleaner assembly is positioned directly above the brush head surface at the handle proximal end.

9. A device for cleaning golf equipment, comprising:

a handle having a proximal and distal end, a scraper pivotally attached to the handle proximate end on a top surface thereof by a pivot pin that is transverse thereto and connected to the handle, the scraper pivotally rotatable via the pivot pin between a closed position, in which the scraper is secured within a channel formed in the handle top surface, and an open position in which the scraper rotates up to 180 degrees to a fully-extended position, and a plurality of metal and plastic bristles extending downward from a bottom surface of the handle at the proximal end and configured so that the plastic bristles are arranged around an outer circumference of the bottom surface to encircle the metal bristles extending from a central portion of the bottom surface of the handle.

10. The device of claim 9, wherein the diameter of the metal bristles is different from the diameter of the plastic bristles.

11. The device of claim 9, wherein the diameter of the metal bristles is wider than the diameter of the plastic bristles.

12. The device of claim 9, wherein the metal bristles are bronze and the plastic bristles are nylon.

* * * * *